US011614255B2

(12) United States Patent
Hirsch et al.

(10) Patent No.: US 11,614,255 B2
(45) **Date of Patent: *Mar. 28, 2023**

(54) LIGHTING CONTROL FOR CHILLED BEAM

(71) Applicant: Air Distribution Technologies IP, LLC, Milwaukee, WI (US)

(72) Inventors: Joachim Hirsch, Colleyville, TX (US); Honghui Zhang, Richardson, TX (US); Ernest Freeman, Dallas, TX (US); Keith Glasch, Plano, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/535,283

(22) Filed: Nov. 24, 2021

(65) Prior Publication Data

US 2022/0082292 A1 Mar. 17, 2022

Related U.S. Application Data

(60) Continuation of application No. 16/516,018, filed on Jul. 18, 2019, now Pat. No. 11,187,430, which is a (Continued)

(51) Int. Cl.
*F24F 13/078* (2006.01)
*F24F 13/02* (2006.01)
(Continued)

(52) U.S. Cl.
CPC ..... *F24F 13/078* (2013.01); *F24F 1/0063* (2019.02); *F24F 1/00075* (2019.02);
(Continued)

(58) Field of Classification Search
CPC .... F24F 13/078; F24F 1/00075; F24F 1/0063; F24F 13/0227; F24F 13/26; F24F 2221/14
See application file for complete search history.

(56) References Cited

U.S. PATENT DOCUMENTS 2,564,334 A * 8/1951 Kennedy ..... F24F 13/072 454/299
2,962,582 A 11/1960 Croft
(Continued)

FOREIGN PATENT DOCUMENTS

CN 103075784 A 5/2013
EP 2386804 A2 11/2011
(Continued)

OTHER PUBLICATIONS

Canadian Office Action for CA Application No. 2,917,679 dated Aug. 24, 2017; 5 pages.
(Continued)

*Primary Examiner* — Andrew J Coughlin
*Assistant Examiner* — Jessica M Apenteng
(74) *Attorney, Agent, or Firm* — Fletcher Yoder, P.C.

(57) ABSTRACT

A device comprising a fin structure, a vent disposed in the fin structure, a cooling coil disposed in the vent, a light disposed in the fin structure and wherein the fin structure is configured to create a Coanda effect for air exiting the vent.

20 Claims, 5 Drawing Sheets

Related U.S. Application Data division of application No. 14/690,216, filed on Apr. 17, 2015, now Pat. No. 10,401,050.

(60) Provisional application No. 62/104,333, filed on Jan. 16, 2015.

(51) Int. Cl.
*F24F 1/0007* (2019.01)
*F24F 1/0063* (2019.01)
*F24F 13/26* (2006.01)

(52) U.S. Cl.
CPC ..... *F24F 13/0227* (2013.01); *F24F 13/26* (2013.01); *F24F 2221/14* (2013.01)

(56) References Cited

U.S. PATENT DOCUMENTS

| | | | | |
|---|---|---|---|---|
| 2,985,090 | A | 5/1961 | Quin | |
| 3,424,233 | A | 1/1969 | Meckler | |
| 3,869,605 | A | 3/1975 | Davis | |
| 8,347,950 | B2 * | 1/2013 | Stroobants | F24D 19/0087 362/147 |
| 2011/0122603 | A1 | 5/2011 | Shamshoian | |
| 2013/0202494 | A1 | 8/2013 | Freedman et al. | |
| 2013/0291735 | A1 * | 11/2013 | Livchak | F24F 13/26 165/48.1 |

FOREIGN PATENT DOCUMENTS

| | | | |
|---|---|---|---|
| GB | 1503441 | A | 3/1978 |
| GB | 2425348 | A | 10/2006 |
| WO | 0214749 | A1 | 2/2002 |
| WO | 03056240 | A1 | 7/2003 |
| WO | 2004085930 | A1 | 10/2004 |
| WO | 2012068569 | A1 | 5/2012 |
| WO | 2014124285 | A2 | 8/2014 |

OTHER PUBLICATIONS

The Reply in response to the Office Action dated Nov. 15, 2016, as filed with the Canadian Intellectual Property Office on May 15, 2017 for the corresponding Canadian Application No. 2,917,678.
The Reply in response to the Office Action dated Nov. 15, 2016, as filed with the Canadian Intellectual Property Office on May 15, 2017 for the corresponding Canadian Application No. 2,917,679.
The Reply in response to the Examiner's Report dated Dec. 15, 2016, as filed with the Canadian Intellectual Property Office on Feb. 8, 2017 for the corresponding Canadian Application No. 171914.
The Examiner's Report dated Jan. 26, 2017 by the Canadian Intellectual Property Office for the corresponding Canadian Application No. 164911.
An Examiner's Report dated Feb. 5, 2016 by the Canadian Intellectual Property Office for the corresponding Canadian Application No. 164911.
An Examiner's Report dated Feb. 5, 2016 by the Canadian Intellectual Property Office for the corresponding Canadian Application No. 164910.
The Response to the Examiner's Report dated Feb. 5, 2016 as filed with the Canadian Intellectual Property Office on Jun. 2, 2016 for the corresponding Canadian Application No. 164910.
The Invitation to pay additional fees and, where applicable, protest fee dated Jul. 19, 2016 by the European Patent Office for the International Patent Application No. PCT/US2016/027866.
The International Search Report and the Written Opinion dated Sep. 13, 2016 by the European Patent Office for the International Patent Application No. PCT/US2016/027866.
The International Search Report and the Written Opinion dated Sep. 12, 2016 by the European Patent Office for the International Patent Application No. PCT/US2016/027851.
An Office Action issued by the Canadian Intellectual Property Office dated Nov. 15, 2016 for co-pending Canadian Patent Application No. 2,917,679.
An Office Action issued by the Canadian Intellectual Property Office dated Nov. 15, 2016 for co-pending Canadian Patent Application No. 2,917,678.

* cited by examiner

LIGHTING CONTROL FOR CHILLED BEAM

CROSS-REFERENCE TO RELATED APPLICATIONS

This application is a continuation of U.S. Non-Provisional patent application Ser. No. 16/516,018, entitled "LIGHTING CONTROL FOR CHILLED BEAM," filed Jul. 18, 2019, which is a divisional of U.S. Non-Provisional patent application Ser. No. 14/690,216, entitled "LIGHTING CONTROL FOR CHILLED BEAM," filed Apr. 17, 2015, which claims priority to and the benefit of U.S. Provisional Application No. 62/104,333, entitled "CHILLED BEAM," filed Jan. 16, 2015, each of which is hereby incorporated by reference in its entirety for all purposes.

TECHNICAL FIELD

The present disclosure relates generally to heating, ventilation and air conditioning (HVAC) systems, and more specifically to a chilled beam light and temperature control.

BACKGROUND OF THE INVENTION

Chilled beams are typically used to provide cooled air, but can block light sources and, when exposed to low water temperatures or high humidity, generate condensation that drips on persons underneath the chilled beam.

SUMMARY OF THE INVENTION

A chilled beam is disclosed that uses a fin structure to create a Coanda effect, to modify the flow of air from the chilled beam from a vent disposed in the fin structure. A cooling coil disposed in the vent is used to chill the air from the vent, and a light is disposed in the fin structure.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
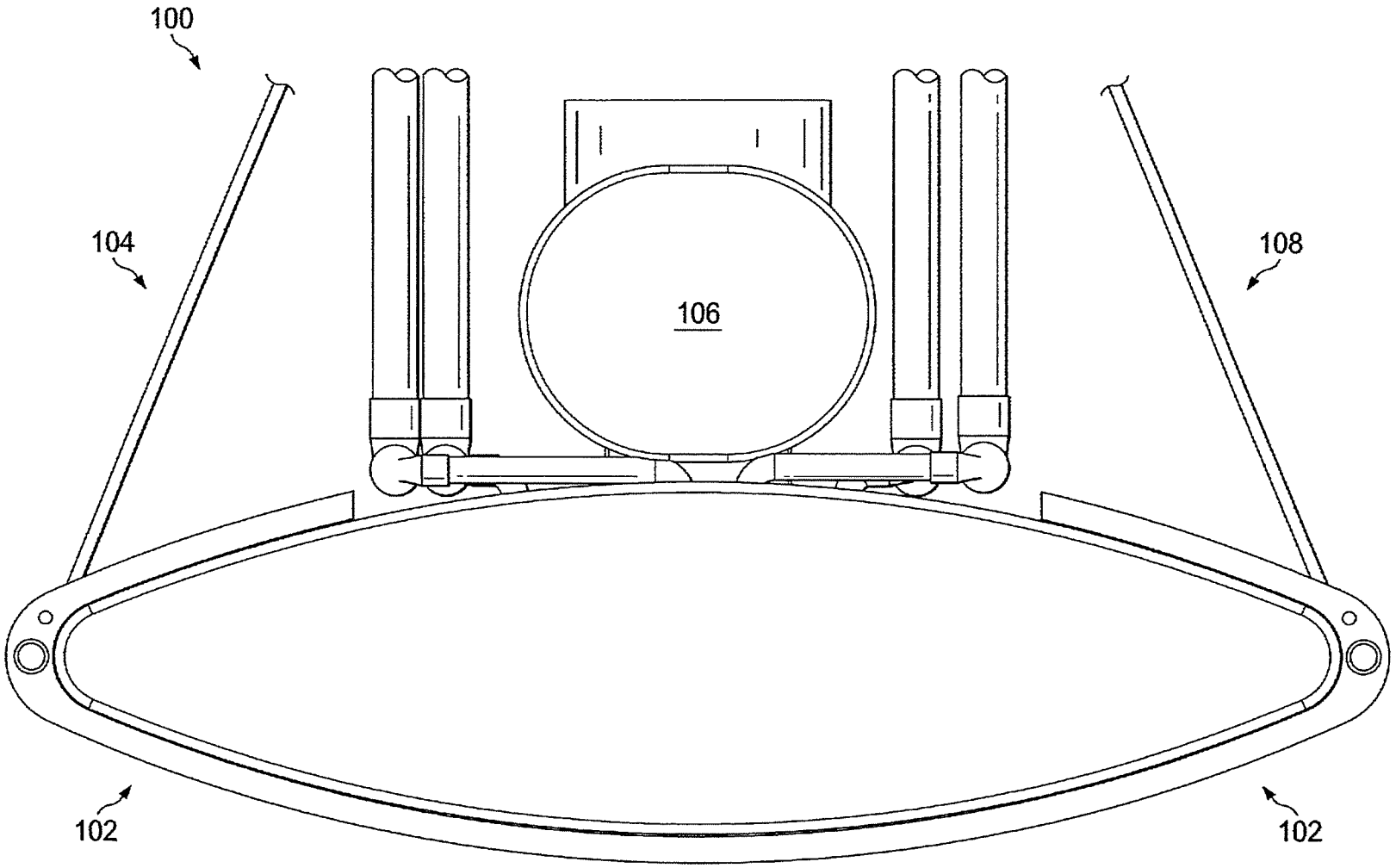
FIG. 1 is a diagram of a chilled beam in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of chilled beam 100 in accordance with an exemplary embodiment of the present disclosure. Chilled beam 100 can be constructed from metallic materials such as stainless steel, copper and aluminum, can include additional decorative and functional components made from plastic, wood or other materials, and can include other suitable system components, such as lighting modules and valve controllers.

Chilled beam 100 includes fins 102, which are used to create a Coanda effect to cause conditioned air to flow out of chilled beam 100 to the left and right of chilled beam 100, instead of in a downward direction from chilled beam 100. Fins 102 are arcuate and symmetrical about an X axis and a Y axis of chilled beam 100, and extend equidistant from a center line of chilled beam 100, but can also or alternatively be provided in other suitable configurations, such as with an asymmetrical structure about the X axis, with an asymmetrical structure about the Y axis, with a design that does not create a Coanda effect on one or both sides or in other suitable configurations.

In addition, fins 102 include lighting fixtures that are disposed in the top and bottom of each fin, to provide for both direct and indirect lighting. Piping manifold 104 is used to supply heated or chilled water or other suitable heating and cooling media to chilled beam 100. Air duct 106 provides air to chilled beam 100 for heating or cooling, such as fresh air from outside of a building, recirculated air from inside of a building, a mix of fresh and recirculated air or air from other suitable sources. Supports 108 provide the structural support for chilled beam 100, and are attached to the ceiling, a beam, a girder, or other suitable support structures.

In operation, chilled beam 100 hangs from a ceiling or other suitable support structure and provides fresh air to a room in conjunction with heating or cooling the air, so as to allow the room climate to be controlled. In addition, chilled beam 100 includes direct and indirect lighting and humidity control, as discussed further herein.

Figure 2:
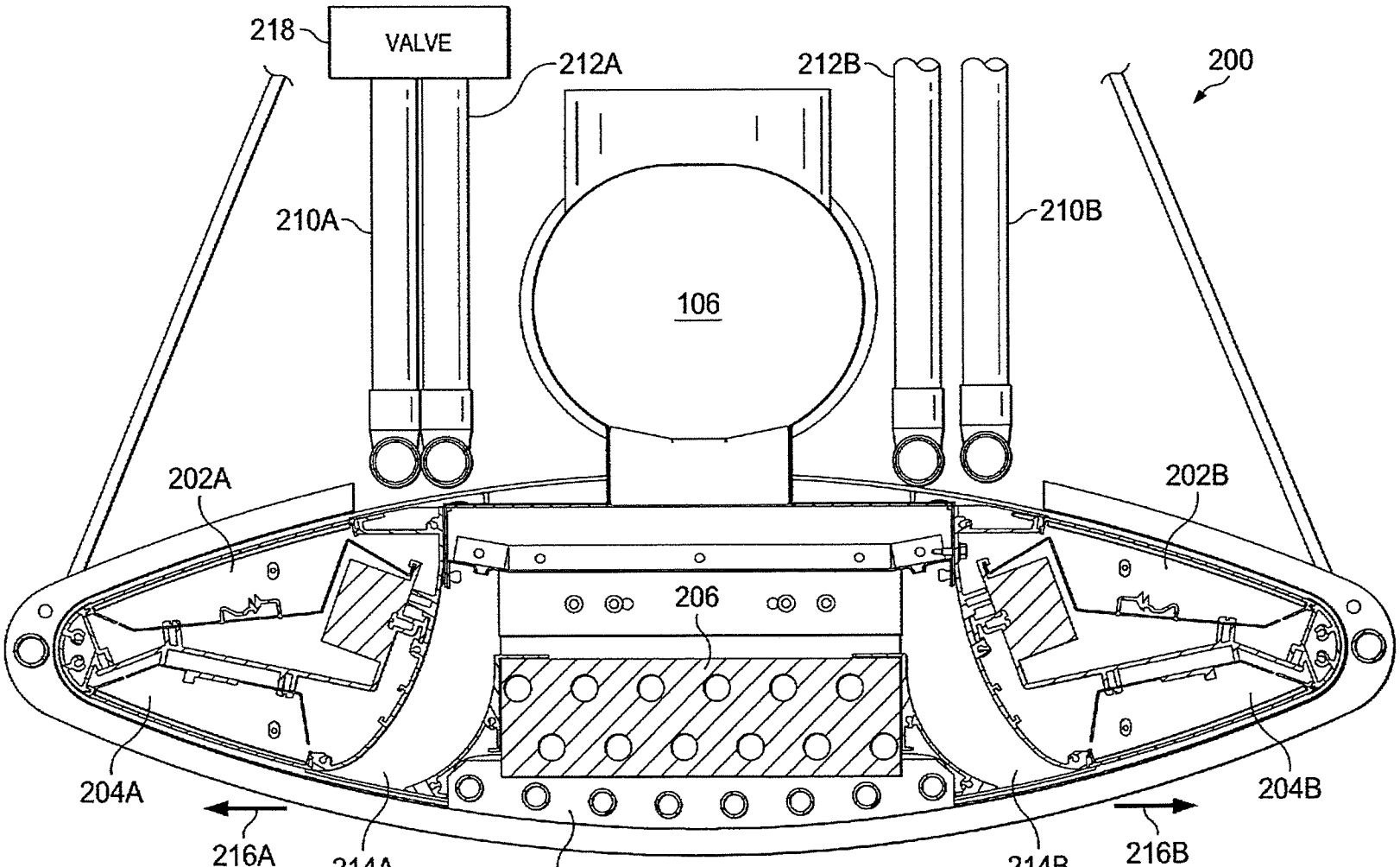
FIG. 2 is a diagram of a chilled beam with direct and indirect lighting, in accordance with an exemplary embodiment of the present disclosure.

FIG. 2 is a diagram of chilled beam 200 with direct and indirect lighting, in accordance with an exemplary embodiment of the present disclosure. Chilled beam 200 includes indirect lighting fixtures 202A and 202B and direct lighting fixtures 204A and 204B, which are coupled to a suitable controller (not explicitly shown) to allow a user to turn on either or both of indirect lighting fixtures 202A and 202B and either or both of direct lighting fixtures 204A and 204B. In this manner, a user who is working underneath chilled beam 200 can turn on direct lighting fixtures 204A and 204B if additional direct lighting is required, whereas indirect lighting fixtures 202A and 202B can be used to provide ambient lighting to the room.

Chilled beam 200 further includes fluid inlets 210A and 212A and fluid outlets 210B and 212B, which can provide heated water on 212A and 212B or chilled water on 210A and 210B, steam or other suitable fluids to heat exchanger coils 206 and pipes 208. A valve structure 218 with one or more separate valves can be used to control the flow of heated or chilled water, and can be disposed at a suitable location, either within chilled beam 200 or at a location along the supply lines to fluid inlets 210A and 212A. In one exemplary embodiment, chilled water can be provided to heat exchanger coils 206, which remove heat from air provided by duct 106 to vents 214A and 214B. As previously discussed, the shape of fins 102 causes the air from vents 214A and 214B to travel in directions 216A and 216B, respectively, due to the Coanda effect, instead of blowing directly downward onto any persons who happen to be underneath chilled beam 200. In this manner, the temperature of the air within a room or other enclosed space can be controlled while avoiding exposure of persons within the room or enclosed space to drafts. In addition, heated water can be provided to pipes 208, which are disposed underneath heat exchanger coils 206, so as to raise the ambient temperature in the vicinity of the bottom of heat exchanger coils 206 so as to prevent the formation of condensation. In the absence of heated pipes 208, such condensation could accumulate and drip onto persons who happen to be underneath chilled beam 200. A controller (not explicitly shown) can be used to measure the relative humidity of the air within the room or enclosed space, and heated water, steam or other suitable heating can be provided to pipes 208 when the humidity is above a level at which condensation forms. Pipes 208 can also be provided without any connection to a source of heating, such as in areas with low relative humidity, for decorative purposes only.

In addition, heated water, steam or other suitable heating fluids can be provided to pipes 208 for the purpose of heating the room or enclosed space by radiant heating, such as during the night when air is not being provided to the room through duct 106 and vents 214A and 214B. In this manner, chilled beam 200 can be used both for providing cooling during the day and heating during the night.

Figure 3:
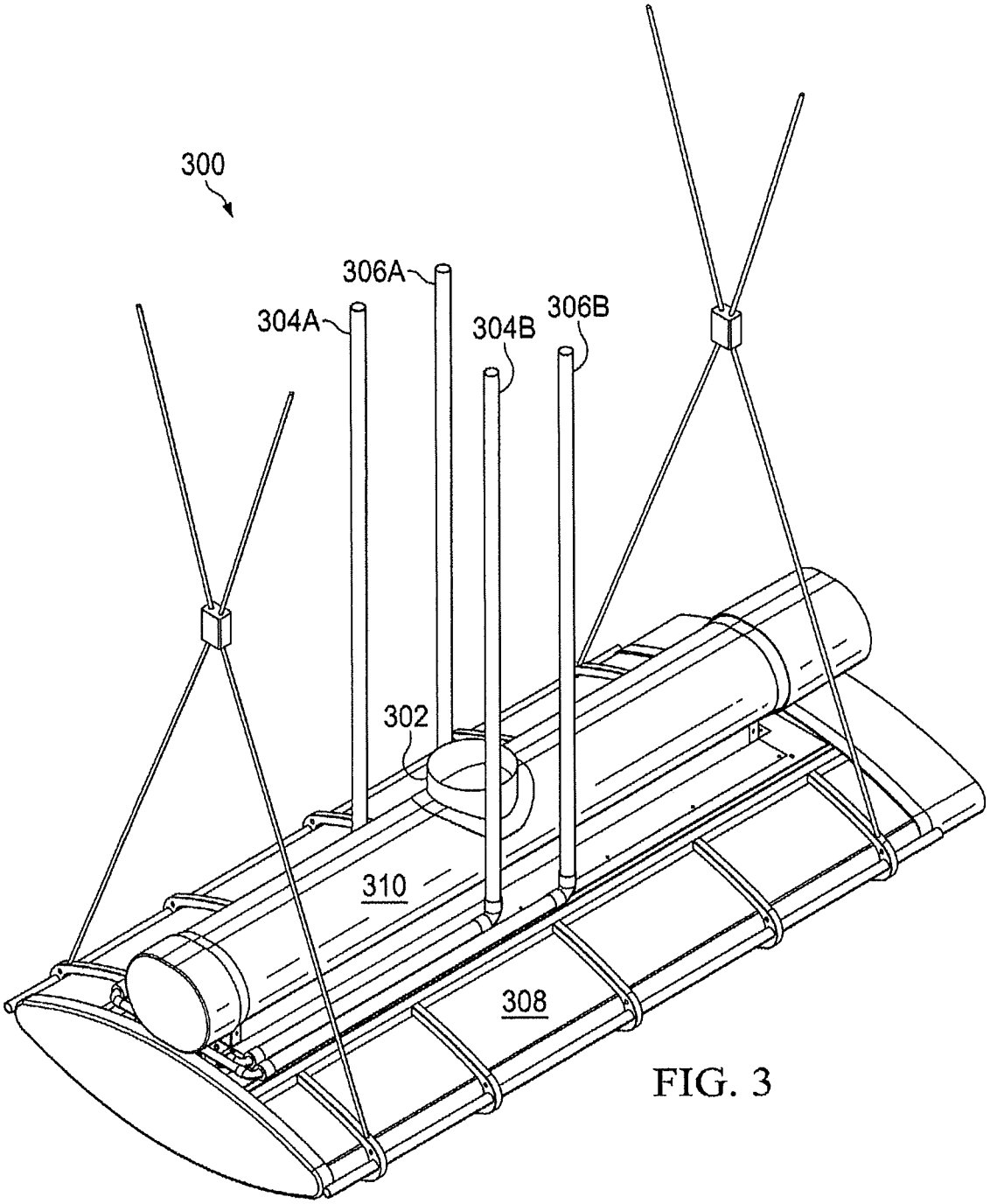
FIG. 3 is a diagram of a chilled beam with an air duct interface, in accordance with an exemplary embodiment of the present disclosure.

FIG. 3 is a diagram of chilled beam 300 with air duct interface 302, in accordance with an exemplary embodiment of the present disclosure. Air duct interface 302 is used to couple chilled beam 300 to an air duct (not explicitly shown), to allow fresh or combined fresh and recirculated air to be provided to chilled beam 300. In addition, fluid inlets 304A and 306A and fluid outlets 304B and 306B are used to convey chilled or heated water or other suitable fluids to chilled beam 300. Fluid inlets 304A and 306A and fluid outlets 304B and 306B extend downward from a ceiling or other suitable structures, parallel and adjacent to the duct that is used to provide fresh or combined fresh and recirculated air to chilled beam 300, and then turn 90 degrees and run parallel and adjacent to fins 308 and duct 310.

Figure 4:
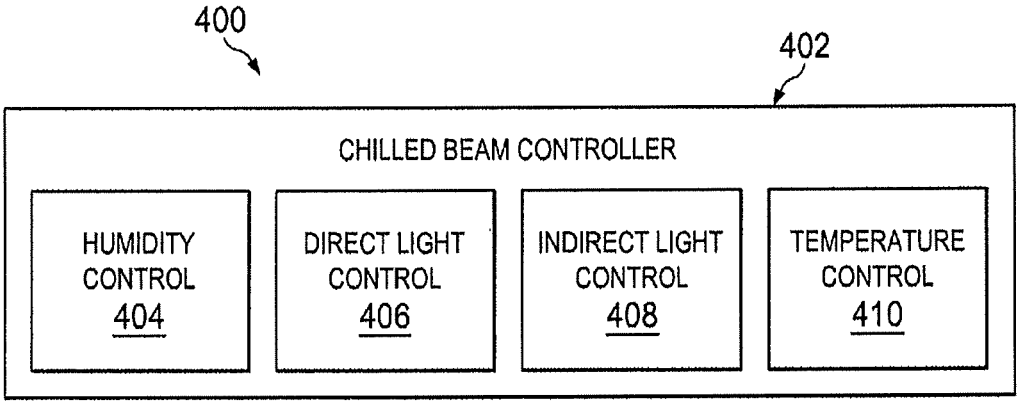
FIG. 4 is a diagram of a system for controlling a chilled beam, in accordance with an exemplary embodiment of the present disclosure.

FIG. 4 is a diagram of a system 400 for controlling a chilled beam, in accordance with an exemplary embodiment of the present disclosure. System 400 can be implemented in hardware or a suitable combination of hardware and software, and can be one or more software systems operating on one or more special purpose processors. In one exemplary embodiment, system 400 can be implemented on a touch screen user interface device and an associated processor that includes wireless connectivity to temperature sensors, humidity sensors, valve operators, lighting controllers, building energy management systems and other suitable systems and components.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Humidity control 404 receives temperature data from a room temperature sensor, temperature data from a chilled water source, humidity data from a room humidity sensor, humidity data from an air source humidity sensor and other suitable data, and determines whether local heating on a surface adjacent to a cooling coil is needed to prevent condensation on the cooling coil. In this exemplary embodiment, dew point tables or other suitable data can be used to determine whether chilled water that is being provided to a cooling coil of a heat exchanger will cause condensation to form on the coil. If it is determined that condensation will form, humidity control 404 can actuate a control valve to allow heated water to flow to pipes that are disposed underneath the cooling coil, so as to decrease the relative humidity of air in the immediate vicinity of the cooling coil, and prevent the formation of condensation. Likewise, if the humidity content of air within the room is different from the humidity content of fresh air that is being provided to the chilled beam, then additional processing can be used to determine whether the control valve for heated water should be activated, such as based on design factors of the chilled beam and the measured room and air source humidity levels, air flow rates or other data.

Direct light control 406 provides automatic or user control for direct lighting of a space underneath a lighted chilled beam. In one exemplary embodiment, a motion sensor or other device can be used to determine whether a person is underneath the lighted chilled beam, and direct light control 406 can activate direct lighting of the lighted chilled beam if the motion sensor data or other suitable data indicates that a person is present. In addition or alternatively, a switch, touch screen interface or suitable user control can be used to allow a user to manually turn direct lighting on or off, as needed.

Indirect light control 408 provides automatic or user control of indirect lighting of a space in the vicinity of a lighted chilled beam. In one exemplary embodiment, a motion sensor, a timer or other suitable devices can be used to determine whether indirect lighting should be provided in a space, such as during normal working hours or when persons are present, and indirect light control 408 can activate indirect lighting of the lighted chilled beam if the motion sensor data, timer data or other suitable data indicates that indirect lighting should be activated. In addition or alternatively, a switch, touch screen interface or suitable user control can be used to allow a user to manually turn direct lighting on or off, as needed.

Temperature control 410 receives temperature data from a room temperature sensor, temperature data from a chilled water source, timer data from a clock and other suitable data, and determines whether chilled water should be provided to a cooling coil of a chilled beam, whether heated water or other suitable heat sources should be used to heat pipes or other suitable radiant heaters, or if other suitable temperature controls should be implemented. In this exemplary embodiment, room temperature measurement data and settings or other suitable data can be used to determine if the room temperature should be reduced by providing chilled water to a cooling coil of a heat exchanger or if the room temperature should be increased by providing heated water to a radiant heater. If it is determined that chilled or heated water should be provided, temperature control 410 can actuate one or more control valves to allow the chilled or heated water to flow as needed. Likewise, a user-controllable thermostat, a touch screen interface or other suitable devices can be used to allow a user to control the temperature of the room.

Figure 5:
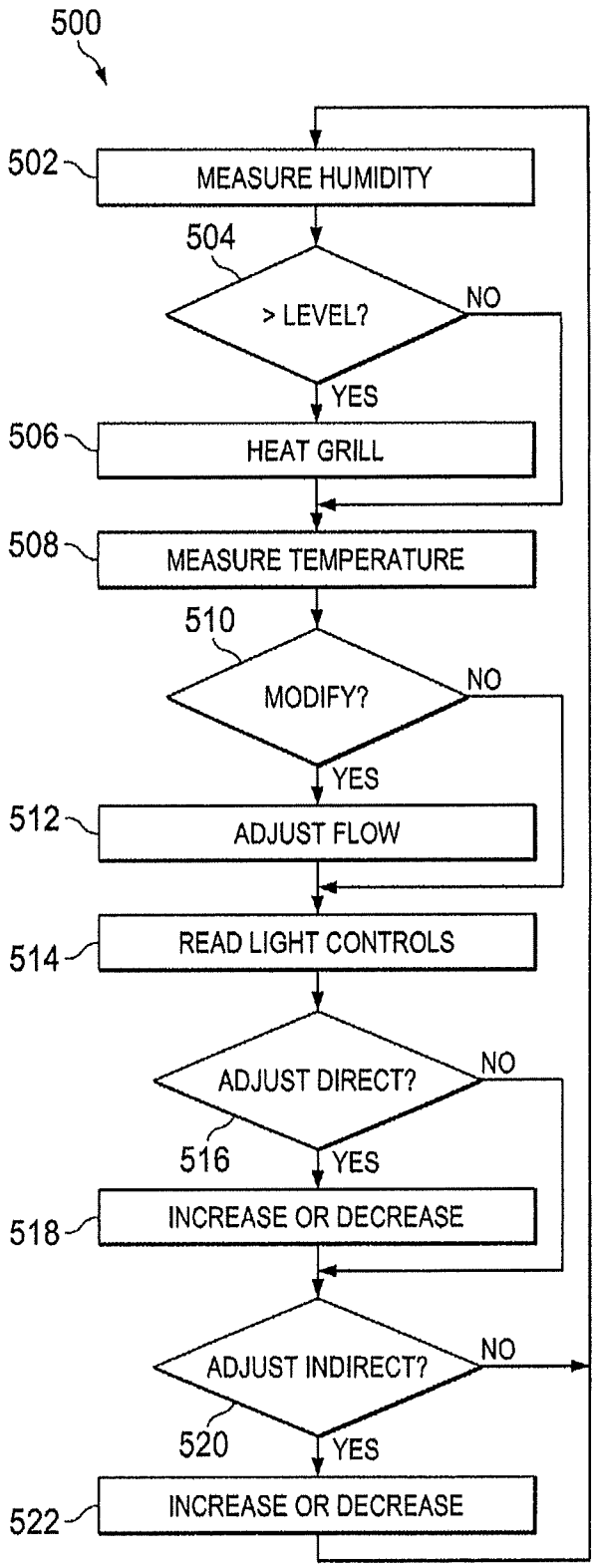
FIG. 5 is a diagram of an algorithm for controlling a chilled beam, in accordance with an exemplary embodiment of the present disclosure.

FIG. 5 is a diagram of an algorithm 500 for controlling a chilled beam, in accordance with an exemplary embodiment of the present disclosure. Algorithm 500 can be implemented in hardware or a suitable combination of hardware and software, and can be one or more algorithms operating on a programmable controller or other suitable devices.

Algorithm 500 begins at 502, where the humidity content of room air, outside air provided by ductwork or other suitable air is measured. In one exemplary embodiment, the humidity can be measured based on the source that is the major contributor to condensation, such as when the humidity content of air within the controlled space is significantly greater or lesser than the humidity content of external air that is being provided to the controlled space. In addition, the air temperature within the controlled space, the air temperature of the external air, the temperature of the chilled water or other suitable temperature data that is needed to determine whether condensation will form can be obtained. The algorithm then proceeds to 504.

At 504, it is determined whether the measured humidity is greater than a predetermined level at which condensation will form, such as by comparing the measured humidity to a table as a function of the air temperature, the water temperature of chilled water that is being provided to the chilled beam, or other suitable data. If the humidity does not exceed the predetermined level, the algorithm proceeds to 508, otherwise the algorithm proceeds to 506 where heat is provided to a grill that is adjacent to cooling coils where condensation would otherwise form. In one exemplary embodiment, the heat can be provided by heated water, steam, electrical heating or other suitable heating, the amount of heat can be varied as a function of the measured humidity, or other suitable processes can also or alternatively be used. The algorithm then proceeds to 508.

At 508, the room temperature is measured, such as for room temperature control or other suitable purposes. In one exemplary embodiment, a thermostat or other suitable device can be used to measure the temperature. The algorithm then proceeds to 510, where it is determined whether the temperature needs to be modified. In one exemplary embodiment, temperature set points as a function of time can be used to determine whether the temperature in a space needs to be increased or lowered, a user control can be provided to allow a user to increase or decrease the temperature as desired, or other suitable processes can also or alternatively be used. If it is determined that no modification is required, the algorithm proceeds to 514, otherwise the algorithm proceeds to 512, where a flow of heated or chilled water is adjusted as required in response to the temperature data and settings, such as by opening or closing one or more control valves. The algorithm then proceeds to 514.

At 514, light control data is read, such as by determining a state of a touch screen controller, a switch or other suitable light controls. The algorithm then proceeds to 516, where it is determined whether an adjustment is required to a direct lighting control, such as in response to a user selection, motion sensor data or other suitable data. If it is determined that no adjustment is required, the algorithm proceeds to 520, otherwise the algorithm proceeds to 518, where the direct lighting is increased or decreased in response to the control data. The algorithm then proceeds to 520.

At 520, it is determined whether an adjustment is required to an indirect lighting control, such as in response to a user selection, time of day data or other suitable data. If it is determined that no adjustment is required, the algorithm returns to 502, otherwise the algorithm proceeds to 522, where the indirect lighting is increased or decreased in response to the control data. The algorithm then returns to 502.

Although algorithm 500 is shown as a flow chart, other suitable programming paradigms can also or alternatively be used to implement algorithm 500, such as a state diagram, two or more dedicated control algorithms of separate control devices, or other suitable configurations.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A chilled beam, comprising:

a fin structure comprising an arcuate shape, wherein the fin structure is configured to receive air from an air duct; and a vent disposed in the fin structure, wherein the vent is configured to direct the air out of the fin structure, and wherein the arcuate shape of the fin structure is configured to guide the air discharged from the vent to flow laterally outward relative to the chilled beam.

2. The chilled beam of claim 1, wherein the fin structure comprises a first fin and a second fin, wherein the first fin and the second fin extend along a length of the chilled beam, and wherein the first fin and the second fin each comprise the arcuate shape.

3. The chilled beam of claim 2, wherein the first fin and the second fin are symmetrical about the length of the chilled beam.

4. The chilled beam of claim 2, wherein the vent is a first vent disposed in the first fin, and the chilled beam comprises a second vent disposed in the second fin.

5. The chilled beam of claim 2, comprising:

a first support coupled to the first fin; and a second support coupled to the second fin, wherein the first support and the second support are configured to be attached to a support structure and suspend the chilled beam from the support structure.

6. The chilled beam of claim 1, comprising one or more heat exchanger coils disposed therein, wherein the one or more heat exchanger coils are disposed downstream of the air duct and upstream of the vent relative to a flow direction of the air through the chilled beam, and wherein the one or more heat exchanger coils are configured to circulate a fluid therethrough and remove heat from the air received via the air duct.

7. The chilled beam of claim 6, comprising a heat source disposed adjacent to the one or more heat exchanger coils, wherein the heat source is configured to reduce condensation formation on the one or more heat exchanger coils.

8. The chilled beam of claim 7, wherein the heat source comprises one or more pipes configured to circulate a heated fluid therethrough.

9. The chilled beam of claim 1, comprising:

one or more direct light sources disposed at a bottom portion of the fin structure; and one or more indirect light sources disposed at a top portion of the fin structure.

10. A chilled beam, comprising:

a duct interface configured to couple to an air duct and direct air from the air duct into the chilled beam;

a fin structure comprising an arcuate shape; and a vent disposed in the fin structure, wherein the vent is configured to receive air from the air duct and direct the air out of the chilled beam, and wherein the arcuate shape of the fin structure is configured to guide the air discharged from the vent laterally outward, instead of downward, relative to the chilled beam.

11. The chilled beam of claim 10, wherein the fin structure comprises a first fin and a second fin, the first fin and the second fin extend along a length of the chilled beam, the first fin and the second fin each comprise the arcuate shape, the first fin extends in a first lateral direction relative to the air duct, and the second fin extends in a second lateral direction, opposite the first lateral direction, relative to the air duct.

12. The chilled beam of claim 11, wherein the vent is a first vent disposed in the first fin, and the chilled beam comprises a second vent disposed in the second fin.

13. The chilled beam of claim 10, comprising one or more heat exchanger coils disposed therein and configured to remove heat from the air received via the air duct.

14. The chilled beam of claim 13, comprising a heat source disposed adjacent to the one or more heat exchanger coils, wherein the heat source is configured to reduce formation of condensation on the one or more heat exchanger coils.

15. The chilled beam of claim 14, wherein the heat source is disposed on a side of the one or more heat exchanger coils opposite the air duct.

16. A chilled beam, comprising:

a duct interface configured to receive an air flow and direct the air flow into the chilled beam;

a fin structure comprising an arcuate shape; and a vent disposed in the fin structure, wherein the vent is configured to discharge the air flow from the chilled beam, wherein the arcuate shape of the fin structure curves upwardly, relative to a vertical direction, and away from the vent, and wherein the fin structure is configured to guide the air flow discharged via the vent along the arcuate shape of the fin structure in a lateral direction.

17. The chilled beam of claim 16, wherein the fin structure comprises a plurality of fins, each fin of the plurality of fins extends along a length of the chilled beam, and each fin of the plurality of fins comprises the arcuate shape.

18. The chilled beam of claim 17, wherein the plurality of fins comprises a first fin and a second fin, and the first fin and the second fin are symmetrical about the length of the chilled beam.

19. The chilled beam of claim 16, comprising:

one or more heat exchanger coils disposed therein and configured to circulate a fluid therethrough;

at least one fluid inlet fluidly coupled to the one or more heat exchanger coils, wherein the at least one fluid inlet is configured to direct the fluid into the chilled beam and the one or more heat exchanger coils; and at least one fluid outlet fluidly coupled to the one or more heat exchanger coils, wherein the at least one fluid outlet is configured to direct the fluid out of the one or more heat exchanger coils and the chilled beam.

20. The chilled beam of claim 19, wherein:

the fluid comprises a chilled fluid, and the one or more heat exchanger coils are configured to remove heat from the air flow received via the duct interface;

the fluid comprises a heated fluid, and the one or more heat exchanger coils are configured to reduce formation of condensation on the one or more heat exchanger coils; or both.

* * * * *